US010501990B2

(12) United States Patent
Moss et al.

(10) Patent No.: US 10,501,990 B2
(45) Date of Patent: Dec. 10, 2019

(54) LADDERS, LADDER COMPONENTS AND RELATED METHODS

(71) Applicant: Wing Enterprises, Incorporated, Springville, UT (US)

(72) Inventors: N. Ryan Moss, Mapleton, UT (US); Sean Peterson, Santaquin, UT (US); Brian Russell, Salt Lake City, UT (US)

(73) Assignee: WING ENTERPRISES, INCORPORATED, Springville, UT (US)

( * ) Notice: Subject to any disclaimer, the term of this patent is extended or adjusted under 35 U.S.C. 154(b) by 0 days.

(21) Appl. No.: 14/696,829

(22) Filed: Apr. 27, 2015

(65) Prior Publication Data

US 2015/0226003 A1 Aug. 13, 2015

Related U.S. Application Data

(62) Division of application No. 13/402,013, filed on Feb. 22, 2012, now Pat. No. 9,016,434.

(Continued)

(51) Int. Cl.

*E06C 7/42* (2006.01)
*E06C 1/22* (2006.01)

(Continued)

(52) U.S. Cl.

CPC ..... *E06C 7/42* (2013.01); *E06C 1/22* (2013.01); *E06C 1/39* (2013.01); *E06C 1/397* (2013.01);

(Continued)

(58) Field of Classification Search

CPC ..... E06C 7/42; E06C 7/46; G01C 9/26

See application file for complete search history.

(56) References Cited

U.S. PATENT DOCUMENTS 600,196 A 3/1898 Duryea
607,808 A 7/1898 Tiefel (Continued)

FOREIGN PATENT DOCUMENTS

DE 378937 C * 8/1923 ..... E06C 7/46
EP 1783322 A1 5/2007

(Continued)

OTHER PUBLICATIONS

International Search Report for International Application No. PCT/US2009/036402, dated Oct. 27, 2009.

(Continued)

*Primary Examiner* — Colleen M Chavchavadze
(74) *Attorney, Agent, or Firm* — Dorsey & Whitney LLP

(57) ABSTRACT

Ladders, ladder components and related methods are provided including various embodiments of a combination ladder. In some embodiments, a platform is provided that is fixedly coupled with a rail assembly of a combination ladder. The platform may pivot between a useable position or state and a stowed or stored position or state. The platform may maintain a position relative to certain rungs of the rail assembly while being displaceable relative to other rungs of the rail assembly. A hand rail may be coupled to the rail assembly and a tray may be coupled with the hand rail. The tray and the platform may be configured to maintain a constant distance between one another while the rail assembly is adjusted for height.

8 Claims, 14 Drawing Sheets

Related U.S. Application Data

(60) Provisional application No. 61/445,387, filed on Feb. 22, 2011.

(51) Int. Cl.

| | |
|---|---|
| ***E06C 1/39*** | (2006.01) |
| ***E06C 1/397*** | (2006.01) |
| ***E06C 7/14*** | (2006.01) |
| ***E06C 7/16*** | (2006.01) |
| ***E06C 7/18*** | (2006.01) |
| ***E06C 7/46*** | (2006.01) |
| ***E06C 7/50*** | (2006.01) |

(52) U.S. Cl.

CPC ..... *E06C 7/14* (2013.01); *E06C 7/16* (2013.01); *E06C 7/182* (2013.01); *E06C 7/46* (2013.01); *E06C 7/50* (2013.01); *Y10T 29/49826* (2015.01)

(56) References Cited

U.S. PATENT DOCUMENTS

| | | | | |
|---|---|---|---|---|
| 622,831 | A | 4/1899 | Wallach et al. | |
| 656,946 | A | 8/1900 | Corduan et al. | |
| 992,915 | A | 5/1911 | Shaw | |
| 1,068,805 | A | 7/1913 | Mosiman | |
| 1,379,419 | A | 5/1921 | Reeves | |
| 1,397,280 | A | 11/1921 | Graf | |
| 2,167,157 | A | 7/1939 | Muehlberg | |
| 2,467,800 | A | 4/1949 | Backlin et al. | |
| 2,827,216 | A | 3/1958 | Napolitano | |
| 2,937,842 | A | 5/1960 | Meek | |
| 2,975,857 | A | 3/1961 | Suroff et al. | |
| 3,057,431 | A | 10/1962 | George | |
| 3,858,684 | A | 1/1975 | Goings et al. | |
| 4,210,224 | A | 7/1980 | Kummerlin et al. | |
| 4,295,544 | A | 10/1981 | Peterson | |
| 4,407,045 | A | 10/1983 | Boothe | |
| 4,574,918 | A | 3/1986 | Marques et al. | |
| 4,620,611 | A | 11/1986 | Good | |
| 4,648,481 | A | 3/1987 | Lee et al. | |
| 4,754,845 | A | 7/1988 | Baker | |
| 4,798,262 | A | 1/1989 | Margolies | |
| 4,826,059 | A | 5/1989 | Bosch et al. | |
| 5,074,377 | A | 12/1991 | Krause | |
| 5,098,052 | A | 3/1992 | Beck | |
| 5,120,013 | A | 6/1992 | Sweeney | |
| D341,895 | S | 11/1993 | Idh | |
| 5,495,915 | A | 3/1996 | Weston et al. | |
| 5,577,574 | A | 11/1996 | Joseph | |
| D388,882 | S | 1/1998 | Kain | |
| 5,704,451 | A | 1/1998 | King | |
| 5,722,507 | A | 3/1998 | Kain | |
| 5,740,883 | A | 4/1998 | Trank | |
| 5,816,363 | A | 10/1998 | Searcy | |
| 5,913,380 | A | 6/1999 | Gugel et al. | |
| 5,950,761 | A * | 9/1999 | Murphy | E06C 7/48 182/108 |
| 5,957,238 | A | 9/1999 | Curvin et al. | |
| 5,967,260 | A | 10/1999 | Spak | |
| 6,073,726 | A | 6/2000 | McCrystal | |
| 6,116,379 | A | 9/2000 | Huss | |
| 6,220,389 | B1 | 4/2001 | Krause | |
| 6,454,050 | B2 | 9/2002 | Gibson et al. | |
| 6,587,022 | B1 | 7/2003 | Devine | |
| 6,614,337 | B1 | 9/2003 | Winnard | |
| 6,637,548 | B2 | 10/2003 | Pass | |
| 6,675,490 | B1 * | 1/2004 | Krehel | G01C 9/26 33/365 |
| 6,698,550 | B2 | 3/2004 | Crain | |
| 6,698,699 | B1 | 3/2004 | Bailey | |
| 6,874,598 | B1 | 4/2005 | Baker | |
| 6,986,405 | B2 | 1/2006 | Meeker | |
| 6,997,282 | B1 | 2/2006 | Sharp et al. | |
| 7,000,732 | B1 | 2/2006 | Briggs, Jr. | |
| 7,032,711 | B1 | 4/2006 | Katz et al. | |
| 7,114,592 | B1 | 10/2006 | Gibson et al. | |
| 7,128,187 | B2 | 10/2006 | Simpson | |
| 7,204,029 | B2 * | 4/2007 | Tran | G01C 9/26 33/379 |
| 7,310,035 | B2 | 12/2007 | Wooten | |
| D576,290 | S | 9/2008 | Meyers et al. | |
| 7,837,010 | B2 * | 11/2010 | Astor | E06C 7/085 182/217 |
| 7,849,967 | B2 | 12/2010 | Gibson et al. | |
| 7,931,123 | B2 | 4/2011 | Moldthan et al. | |
| 9,016,434 | B2 * | 4/2015 | Moss | E06C 1/22 182/106 |
| 9,909,870 | B2 * | 3/2018 | Neitzell | G01C 9/34 |
| 2002/0084143 | A1 | 7/2002 | Roy | |
| 2004/0238278 | A1 | 12/2004 | Gibson et al. | |
| 2005/0121261 | A1 | 6/2005 | Moss et al. | |
| 2006/0006024 | A1 | 1/2006 | Till | |
| 2006/0124397 | A1 | 6/2006 | Vosbein-Jensen | |
| 2006/0249331 | A1 | 11/2006 | Meeker | |
| 2007/0056797 | A1 * | 3/2007 | Wang | B62B 1/12 182/21 |
| 2007/0120028 | A1 | 5/2007 | Kane | |
| 2007/0181368 | A1 | 8/2007 | Simpson | |
| 2007/0181369 | A1 | 8/2007 | Gibson et al. | |
| 2008/0121462 | A1 | 5/2008 | Pucek | |
| 2009/0229918 | A1 | 9/2009 | Moss et al. | |
| 2009/0283361 | A1 | 11/2009 | Gibson et al. | |
| 2010/0230209 | A1 | 9/2010 | Hughes et al. | |
| 2010/0282540 | A1 | 11/2010 | Moss et al. | |
| 2011/0127110 | A1 | 6/2011 | Trang | |
| 2013/0048427 | A1 * | 2/2013 | Sordo | E06C 7/46 182/110 |
| 2014/0238777 | A1 * | 8/2014 | Adair | E06C 7/46 182/108 |
| 2015/0068842 | A1 * | 3/2015 | Moss | E06C 1/32 182/200 |

FOREIGN PATENT DOCUMENTS

| | | | |
|---|---|---|---|
| EP | 1921249 | A1 | 5/2008 |
| JP | 10088949 | A | 4/1998 |
| KR | 200412244 | Y1 | 3/2006 |

OTHER PUBLICATIONS

International Search Report for International Application No. PCT/US2012/025938, dated Jun. 9, 2012.

English abstract and English machine translation of the specification and claims of JP10-088949. Apr. 7, 1998.

English machine translation of the specification and claims of KR 20-0412244. Mar. 23, 2006.

English abstract and English machine translation of the specification and claims of EP 1783322. May 9, 2007.

English abstract and English machine translation of the specification and claims of EP 1921249. May 14, 2008.

* cited by examiner

LADDERS, LADDER COMPONENTS AND RELATED METHODS

CROSS-REFERENCE TO RELATED APPLICATIONS

The present invention claims priority to U.S. application Ser. No. 13/402,013 filed Feb. 22, 2012, which will issue as U.S. Pat. No. 9,016,434 on Apr. 28, 2015, which claims the benefit of U.S. Provisional Patent Application No. 61/445,387 filed Feb. 22, 2011, the disclosures of each of which are incorporated by reference herein in their entireties.

TECHNICAL FIELD

The present invention relates generally to ladders, ladder systems, ladder components and related methods. More specifically, to combination ladders, rail structures, trays, platform configurations and related methods of manufacturing and operating ladders.

BACKGROUND

Ladders are conventionally used to provide a user thereof with improved access to locations that might otherwise be inaccessible. Ladders come in many shapes and sizes, such as straight ladders, straight extension ladders, stepladders, and combination step and extension ladders (referred to herein as combination ladders). Combination ladders incorporate, in a single ladder, many of the benefits of other ladder designs as they can be used as an adjustable stepladder or as an extension ladder.

Ladders are common tools for professional tradesman and homeowners alike. Sometimes the use of a ladder can be an awkward experience, even for those who use ladders on a regular basis, when certain tasks are to be performed while standing on the rungs of a ladder. For example, it can be easy to lose one's balance on a ladder while working on an overhead project (e.g., painting a ceiling, changing a light bulb, etc.) Moreover, when one needs to utilize tools or access other resources (e.g., hardware, paint, etc.) while working on a ladder, the temporary storage of such tools or other items is often problematic. This is particularly true when using a combination ladder which conventionally lacks a top cap often found on a step ladder, the top cap often being used as a surface to place or store small items while working on the ladder. Often, the user of a ladder may have to make many trips up and down the ladder to exchange tools or other equipment during the performance of a particular job, making the use of the ladder less efficient than it could be.

Additionally, standing on a ladder for extended periods of time can cause fatigue. Often the rungs on which one stands are relatively narrow, such that a very small portion of a user's foot is in contact with the rung while using the ladder. Additionally, while not recommended, many users will often stand on a rung higher than is recommended by the manufacturer of the ladder. This can be an obvious safety hazard. For example, while standing on lower rungs, the user can brace themselves against the side rails or against a higher rung of the ladder in an effort to maintain their balance. However, when one stands on higher rungs, the user no longer has rails or other ladder components available to brace their upper bodies against for stability and balance.

It is a continual desire within the industry to improve various aspects of ladders including their safety, functionality, ergonomics and efficiency of use.

BRIEF SUMMARY OF THE INVENTION

In accordance with the present invention, various embodiments of ladders, ladder components and methods of operating and manufacturing ladders are provided. In accordance with one embodiment, a ladder is provided that comprises a first rail assembly and a second rail assembly. The first rail assembly comprises a pair of inner rails and a pair of outer rails slidably coupled to the pair of inner rails, a first plurality of rungs coupled between the pair of inner rails and a second plurality of rungs coupled between the pair of outer rails. The second rail assembly comprises a pair of inner rails and a pair of outer rails slidably coupled to the pair of inner rails, a first plurality of rungs coupled between the pair of inner rails and a second plurality of rungs coupled between the pair of outer rails. The ladder further includes a pair of hinges that rotatably couples the first rail assembly with the second rail assembly. A platform includes a body portion that is coupled with the pair of inner rails of first rail assembly adjacent a rung of the first plurality of rungs. The body portion of the platform is moveable between a first position and a second position relative to the first rail assembly.

In accordance with another embodiment, a ladder comprises a first rail assembly and a second rail assembly. The first rail assembly comprises a pair of inner rails and a pair of outer rails slidably coupled to the pair of inner rails, a first plurality of rungs coupled between the pair of inner rails and a second plurality of rungs coupled between the pair of outer rails. The second rail assembly comprises a pair of inner rails and a pair of outer rails slidably coupled to the pair of inner rails, a first plurality of rungs coupled between the pair of inner rails and a second plurality of rungs coupled between the pair of outer rails. The ladder further includes a pair of hinges rotatably coupling the first rail assembly with the second rail assembly such that the first rail assembly and the second rail assembly may be selectively positioned and maintained in a first configuration and at least a second configuration. When in rail assemblies are in the first configuration, the first rail assembly extends at an acute angle relative to the second rail assembly. When the rail assemblies are in the second configuration, the first rail assembly extends from the first rail assembly in a substantially common plane; The ladder additionally includes a pair of brackets with each bracket being fixedly coupled to the pair of inner rails of the first rail assembly, the pair of brackets being removably coupled with another ladder component. In one embodiment the additional ladder component includes a hand rail. A tray may also be coupled with the hand rail. In another embodiment, the additional ladder component includes a paint tray.

In accordance with another embodiment of the present invention, a method of adjusting a ladder is provided. The method includes providing a first rail assembly having a pair of inner rails with a plurality of rungs coupled therebetween and a pair of outer rails having a plurality of rungs coupled therebetween, pair of inner rails being slidably coupled with the pair of outer rails. The method additionally includes providing a second rail assembly having a pair of inner rails with a plurality of rungs coupled therebetween and a pair of outer rails having a plurality of rungs coupled therebetween, the pair of inner rails being slidably coupled with the pair of outer rails. The first rail assembly is positioned at an acute angle relative to the second rail assembly to provide a self-supporting ladder. A platform is fixed coupled with the first rail assembly and a body portion of the platform is oriented in a first position suitable for a user to stand on. The pair of inner rails of the first rail assembly are displaced relative to the outer rails of the first rail assembly while maintaining the platform at a constant position relative to at least one rung of the plurality of rungs coupled between the inner rails of the first rail assembly.

In accordance with another embodiment of the present invention, a foot for a ladder rail is provided. The foot includes a body portion configured to cover an end of a ladder rail. The body portion includes a flexible locking tab with a feature sized and configured to engage an opening formed in the ladder rail. The body portion of the foot may further be configured to define at least one channel to receive a portion of the ladder rail. In one embodiment, a wheel may be rotatably coupled with body portion. In one example embodiment, the body portion is molded as a substantially homogenous, monolithic member.

In accordance with another embodiment of the present invention, another ladder is provided. The ladder includes at least one rail assembly including a pair of rails and at least one rung coupled between the pair of rails. A first foot is coupled with an end of one of the pair of rails. The first foot includes a body portion configured to cover an end of a ladder rail and includes a flexible locking tab with a feature sized and configured to engage an opening formed in the associated rail.

Other features and embodiments of the invention will become apparent upon study of the subsequent description, associated drawings and appended claims. It is noted that features of one described embodiment herein may be combined with features of another described embodiment without limitation.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
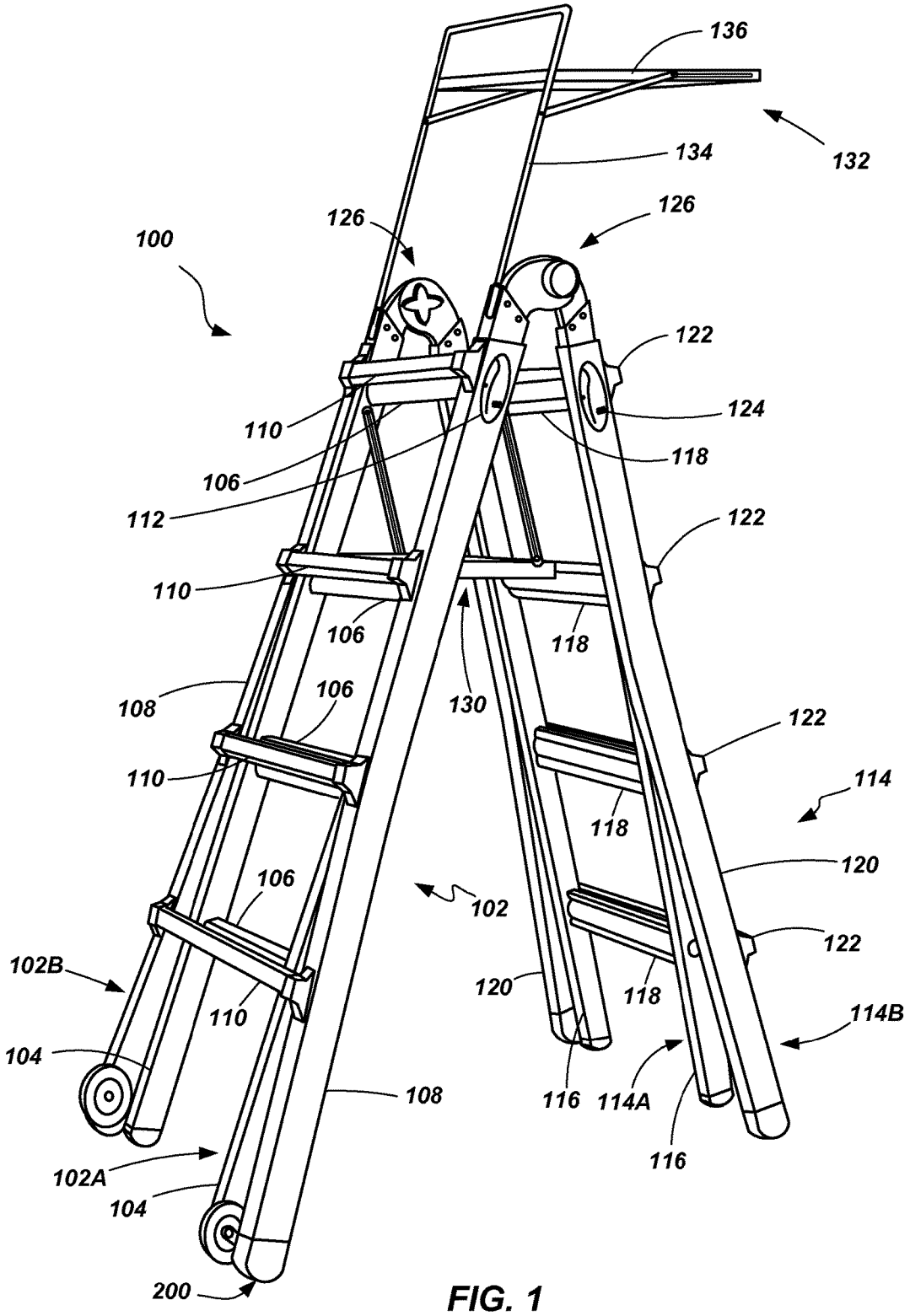
FIG. 1 is a perspective view of a ladder and associated components in accordance with an embodiment of the present invention.

Referring to FIG. 1, a combination ladder 100 is shown. The combination ladder 100 includes a first rail assembly 102 including an inner assembly 102A slidably coupled with an outer assembly 102B. The inner assembly 102A includes a pair of spaced apart rails 104 coupled with a plurality of rungs 106. Likewise, the outer assembly 102B includes a pair of spaced apart rails 108 coupled to a plurality of rungs 110. The rails 104 of the inner assembly 102A are slidably coupled with the rails 106 of the outer assembly 102B. The inner and outer assemblies 102A and 102B may be selectively locked relative to each other such that one or more of their respective rungs 106 and 110 are aligned with each other. A locking mechanism 112 may be configured to engage a portion of the inner rail assembly 102A and the outer rail assembly 102B so as to selectively lock the two assemblies relative to each other. While only a single locking mechanism 112 is shown due to the perspective of the ladder represented in FIG. 1, a second, similar locking mechanism is coupled to the other side of the rail assembly 102.

The combination ladder 100 also includes a second rail assembly 114 that includes an inner assembly 114A slidably coupled with an outer assembly 114B. The inner assembly 114A includes a pair of rails 116 coupled with a plurality of rungs 118 and is configured similar to the inner assembly 102A of the first rail assembly 102A described hereinabove. Likewise, the outer assembly 114B includes a pair of rails 120 coupled with a plurality of rungs 122 and is configured similar to the outer assembly 102B of the first rail assembly 102 described hereinabove. Locking mechanisms 124 may be associated with inner and outer assemblies 114A and 114B to enable selective positioning of the inner assembly 114A relative to the outer assembly 114B as described with respect to the first rail assembly 102 hereinabove.

One exemplary locking mechanism that may be used with the first and second rail assemblies 102 and 114 is described in U.S. Patent Application Publication No. 2009/0229918 filed Mar. 6, 2009, the disclosure of which is incorporated by reference herein in its entirety. While the locking mechanism described in U.S. Patent Application Publication No. 2009/0229918 is generally described in conjunction with an embodiment of an adjustable step ladder, such a locking mechanism may by readily used with an embodiment such as the presently described combination ladder as well. It is additionally noted that, in one embodiment, the rail assemblies 102 and 114 may be configured similar to those which are described in U.S. Pat. No. 4,210,224 to Kummerlin, the disclosure of which is incorporated by reference in its entirety.

The first rail assembly 102 and the second rail assembly 114 are coupled to each other may way of a pair hinge mechanisms 126. Each hinge mechanism 126 may include a first hinge component coupled with a rail of the first rail assembly's inner assembly 102A and a second hinge component coupled with a rail of the second rail assembly's inner assembly 114A. The hinge components of a hinge pair 126 rotate about a pivot member such that the first rail assembly 102 and the second rail assembly 114 may pivot relative to each other. Additionally, the hinge mechanisms 126 may be configured to lock their respective hinge components (and, thus, the associated rails to which they are coupled) at desired angles relative to each other. One example of a suitable hinge mechanism is described in U.S. Pat. No. 4,407,045 to Boothe, the disclosure of which is incorporated by reference herein in its entirety. Of course other configurations of hinge mechanisms are also contemplated as will be appreciated by those of ordinary skill in the art.

The combination ladder 100 is constructed so as to assume a variety of states or configurations. For example, using the locking mechanisms (112 or 124) to adjust a rail assembly (102 or 114) enables the ladder 100 to adjust in height. More specifically, considering the first rail assembly 102, as the rail assembly 102 is adjusted, with the outer assembly 102B being displaced relative to the inner assembly 102A, the associated locking mechanisms 112 engages the inner and outer assemblies (102A and 102B) when they are at desired relative positions with the rungs (106 and 110) of the inner and outer assemblies (102A and 102B) at a desired vertical spacing relative to each other. At some of the adjustment heights of the rail assembly 102, at least some of their respective rungs (106 and 110) align with each other (such as shown in FIG. 1). The second rail assembly 114 may be adjusted in a similar manner.

Considering the embodiment shown in FIG. 1, adjustment of the rail assemblies 102 and 114 enables the ladder 100 to be configured as a step ladder with, for example, four effective rungs at a desired height (as shown in FIG. 1), or to be configured as a step ladder that is substantially taller having five, six, seven or eight effective rungs, depending on the relative positioning of the inner and outer assemblies. However, it is noted that the inner and outer rail assemblies may be configured with more or fewer rungs than four. It is also noted that the first rail assembly 102 and the second rail assembly 114 do not have to be adjusted to similar heights (i.e., having the same number of effective rungs). Rather, if the ladder is used on an uneven surface (e.g., on stairs), the first rail assembly 102 may be adjusted to one height while the second rail assembly 114 may be adjusted to a different height in order to compensate for the slope of the supporting surface.

Additionally, the hinge mechanisms 126 provide for additional adjustability of the ladder 100. For example, the hinge pairs 126 enable the first and second rail assemblies 102 and 114 to be adjusted to a variety of angles relative to each other. As shown in FIG. 1, the first and second rail assemblies 102 and 114 may be configured at an acute angle relative to each other such that the ladder may be used as a self-supporting ladder, similar to a step ladder. However, the first and second rail assemblies 102 and 114 may be rotated or pivoted about the hinge mechanisms 126 so that they extend from one another in substantially the same plane (i.e., exhibiting an angle of substantially 180°) with the hinge mechanisms 126 locking them in such an orientation. When configured in this manner, the ladder 100 may be used as an extension ladder. Moreover, each of the first and second assemblies 102 and 114 are still adjustable as to height (i.e., through the relative displacement of their respective inner and outer assemblies). It is additionally noted that the rungs of the various assemblies (i.e., rungs 106, 110, 118 and 122) are configured to have support surfaces on both the tops and the bottoms thereof so as to enable their use in either a step ladder configuration or an extension ladder configuration.

The ladder 100 also includes a platform 130 that is coupled to the first rail assembly 102. In one embodiment, the platform 130 is coupled with the inner assembly 102A of the first rail assembly 102 and is configured to extend adjacent to a rung 106 of the inner assembly 102A. For example, in the embodiment shown in FIG. 1, the platform 130 is positioned adjacent the rung 106 that is second from the top of the inner assembly 102A and extends towards the rung 118 that is second from the top of the inner assembly 114A of the second rail assembly 114. Further details of the platform 130 will be discussed hereinbelow.

The ladder 100 further includes a component 132 or mechanism that is releasably attached thereto and which may provide a variety of functions. For example, as shown in FIG. 1, the component 132 may be selectively installed or coupled with the ladder 100 (e.g., coupled with a bracket of the ladder) such that a rail 134 (referred to herein as a handrail for purposes of clarity) may extend upward from the ladder 100 at an angle that is generally acute relative to a horizontal line (when the ladder is in an orientation of intended use). The handrail 134, thus, provides support to users, wherein users may grasp or lean on the handrail 134 to brace themselves or help support themselves when working at elevated heights on the ladder 100. In the embodiment shown in FIG. 1, the handrail 134 is shown as extending in a common plane, or at least in a plane that is substantially parallel with, a plane defined by the rails (104 and 108) of the first rail assembly 102, although it may be configured to extend at other angles if desired. Additionally, the component 132 may include a tray 136 or other structure that may be selectively positioned to hold (or support or store), for example, tools, hardware, paint or other items in a convenient and organized manner.

Figure 2:
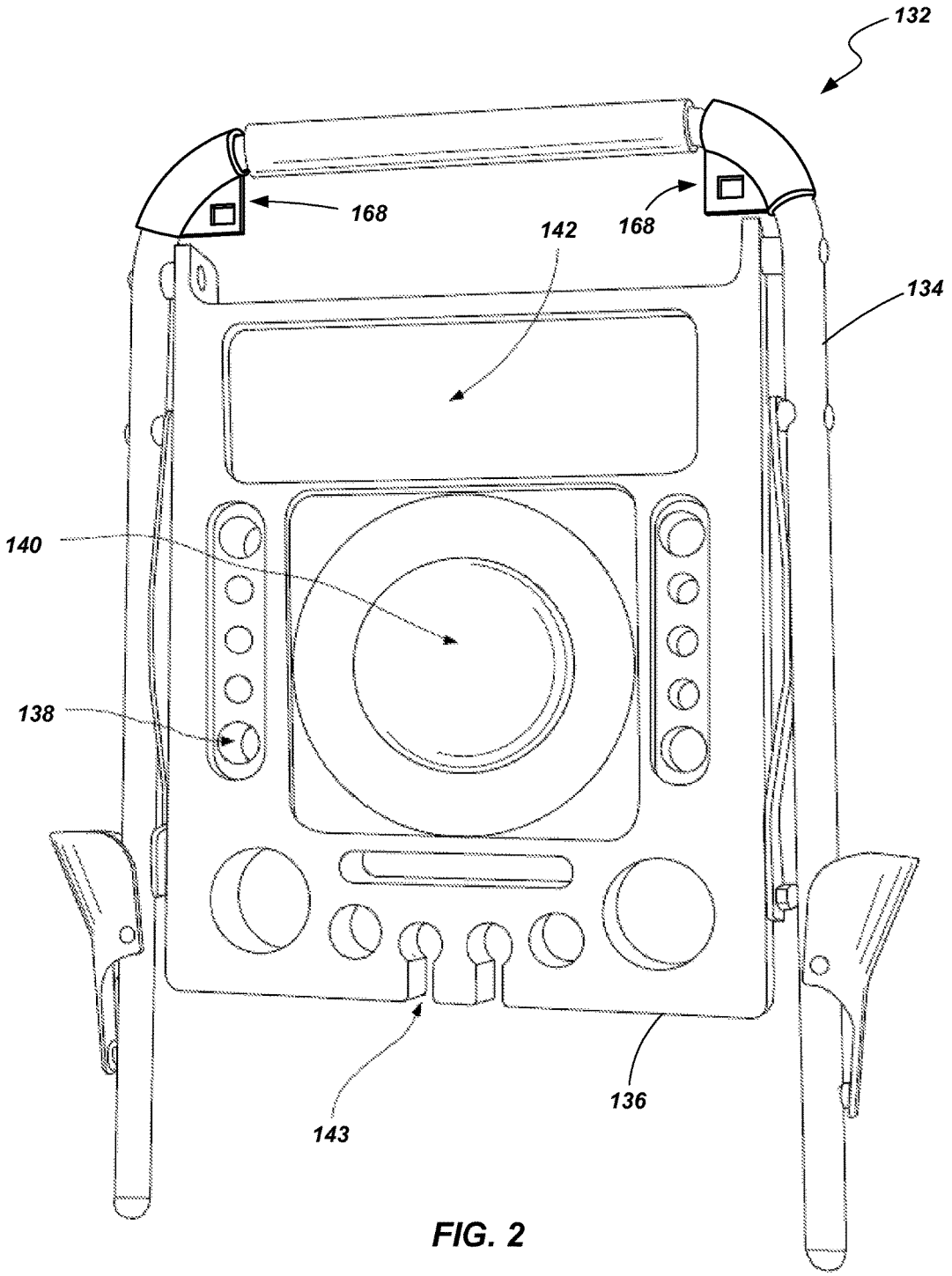
FIG. 2 is a perspective view of a component shown in FIG. 1.

FIG. 2 shows a front view of a component 132 having a handrail 134 and a tray 136 in accordance with one embodiment of the present invention. The tray 136 is movably coupled with the handrail 134 so that it may be selectively positioned relative to the handrail 134 in at least one deployed condition and at least one stowed condition. For example, the tray 136 may be configured to extend in a plane at an acute angle relative to the plane of the handrail 134 while in a deployed state (e.g., as shown in FIG. 1). Additionally, the tray 136 may be configured to extend in a substantially common plane (or at least in a substantially parallel plane) with the plane handrail 134 when in a stored or stowed condition (e.g., such as shown in FIG. 2 as well as FIG. 3 which will be discussed below).

As show in FIG. 2, the tray 136 may include a plurality of openings 138 for holding various tools or other equipment. For example, some of such openings 138 may be sized to pass a portion of a screwdriver therethrough while holding a portion of the screwdriver above the tray 136 providing ready access to the tool for a user. The openings 138 may be variously sized to accept and support different types of tools (e.g., hammers, pliers, etc.). Larger openings may also be formed in a portion of the tray 136 to accommodate temporary storage or holding of, for example, a power tool such as a drill. In the embodiment shown, a recess 140 is formed in the tray 136 to accommodate, for example, the holding of a paint can. Other recesses 142 may be formed in the tray 136 to temporarily hold or store other loose items (e.g., screws, nails, various tools, etc.). The tray 136 may also include magnets disposed beneath or adjacent such recesses to provide further securement of metallic items. The tray 136 may further include slotted apertures 143, for example adjacent the peripheral edges of the tray 136, to hold various items such as the end of an extension cord or the end of a lanyard coupled to a tool or other item. The component 132 may include further features and exhibit other configurations such as, for example, described in U.S. Patent Application Publication No. 2009/0229918, previously incorporated by reference.

Figure 3:
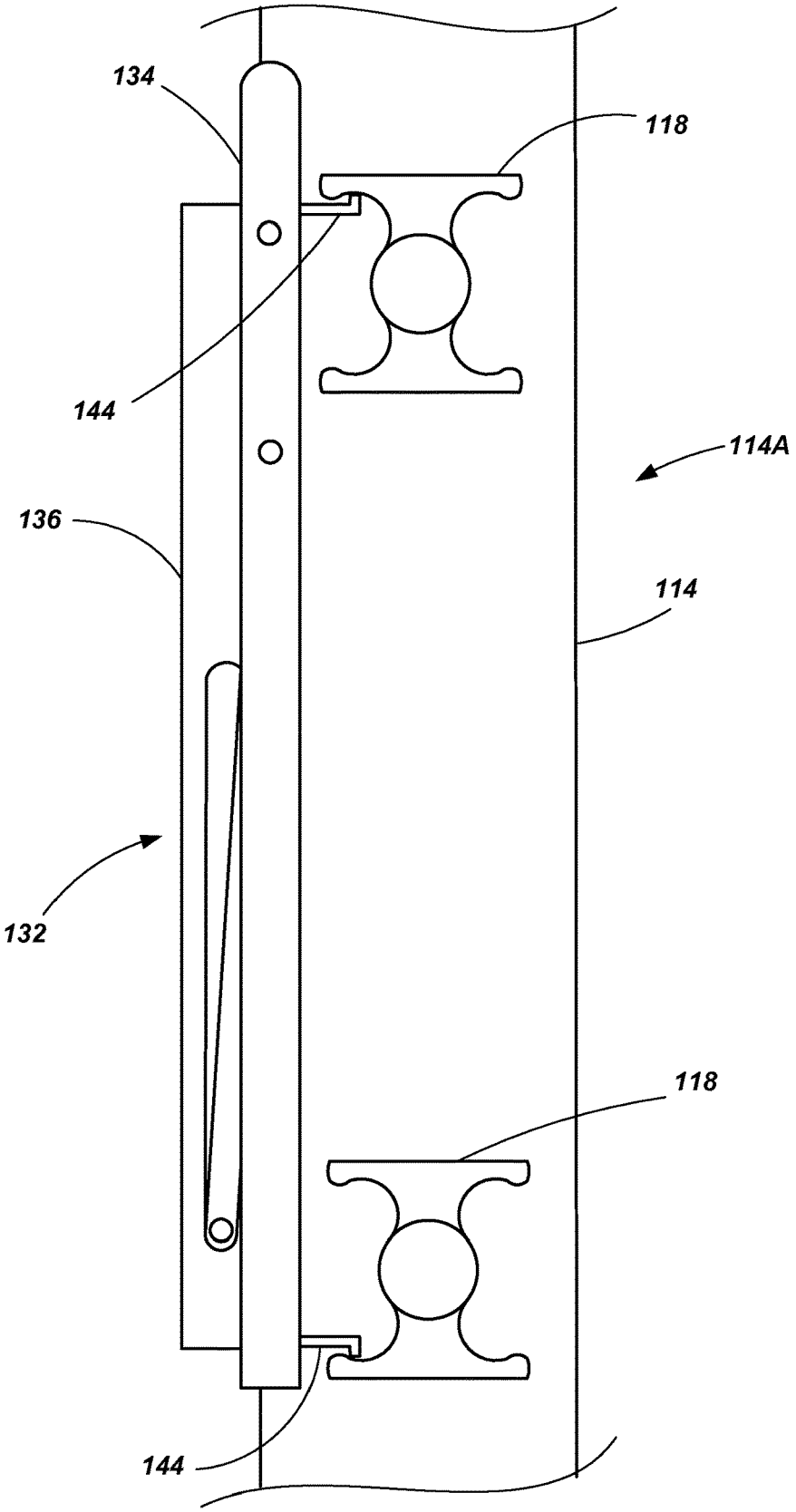
FIG. 3 is a side view of a portion the ladder shown in FIG. 1 with the component shown in FIG. 2 coupled with the ladder in stored state.

Referring briefly to FIG. 3, it is noted that the component 132 having a rail 134 and/or tray 136 may be configured for convenient storage on the ladder 100 when it is not coupled with the ladder in the manner shown in FIG. 1. In one embodiment, the component 132 may include tabs 144 or other structures that are spaced apart and shaped to engage, for example, in two or more rails 118 of the inner assembly 114A of the second rail assembly 114. As seen in FIG. 3, the component is folded or collapsed in a substantially flat state, with the rail 134 and the tray 136 being substantially placed in a common plane (as shown in FIG. 2), and the component 132 is "snapped" or "press-fit" between two adjacent rungs 118 of the second rail assembly 114 such that the tabs 144 engage the adjacent rungs 118 to hold the component 132 in place. The component 132 then remains coupled with the second rail assembly 114 until a user desires to remove it for use with the ladder 100 or in order to provide access to the space between the adjacent rungs 118. Of course other structures or mechanisms may be used to couple the component 132 with the ladder for temporary storage including that which is described in U.S. Patent Application Publication No. 2009/0229918.

Figure 4A:
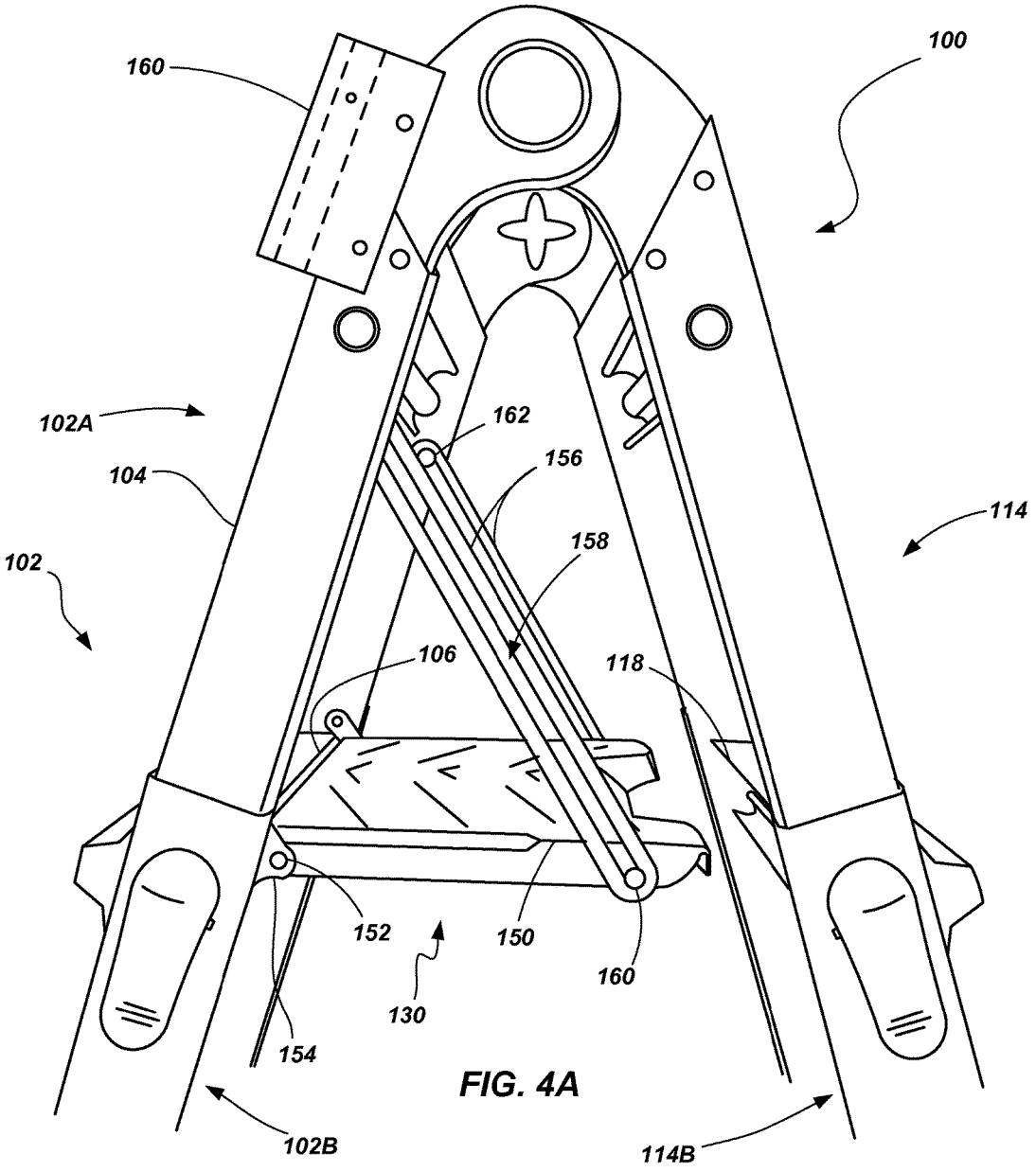
FIGS. 4A and 4B are enlarged perspective views of the ladder shown in FIG. 1 showing certain details.
Figure 4B:
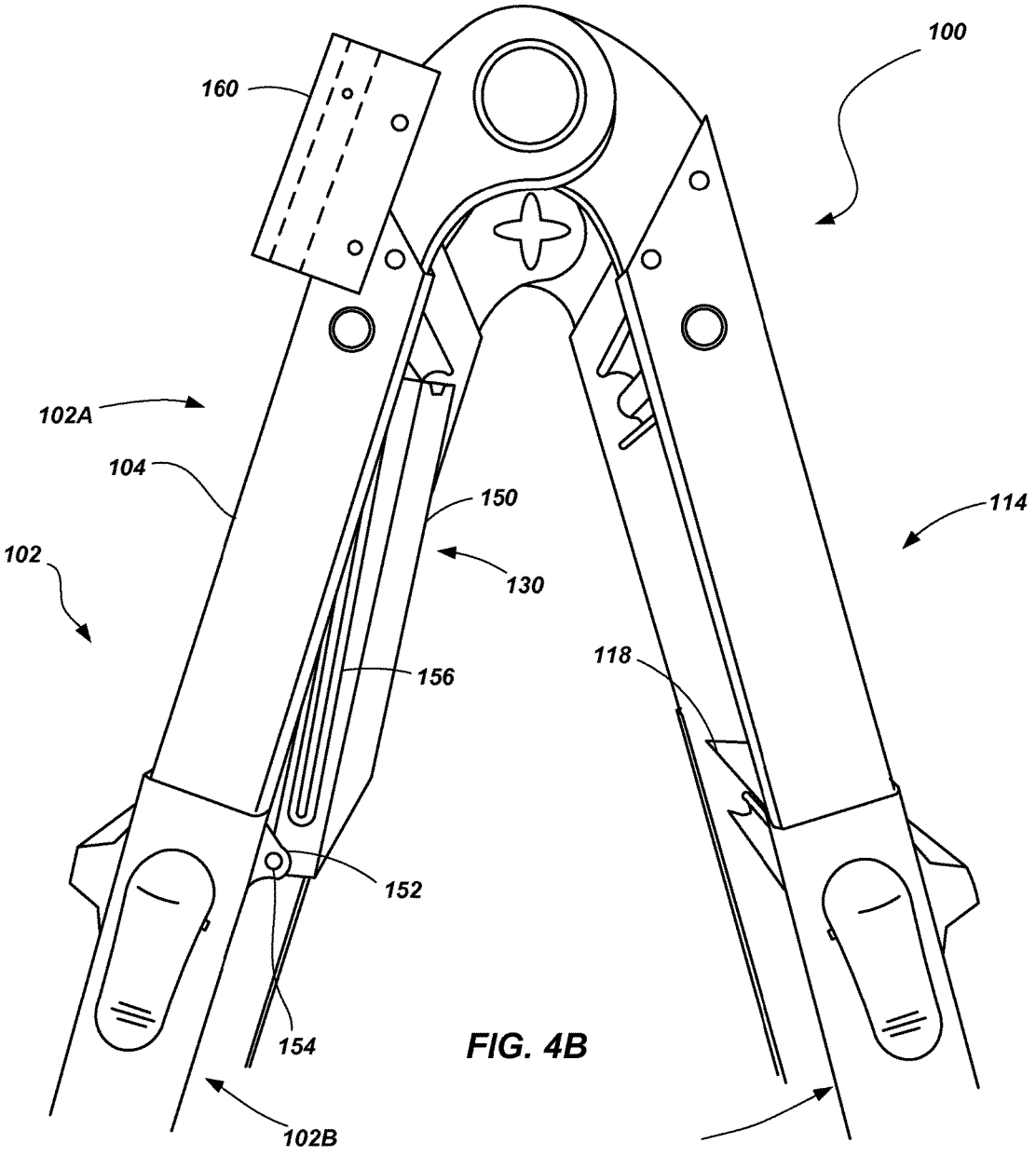

Referring now to FIGS. 4A and 4B, additional details are shown and described with respect to the platform 130. It is noted that the outer assemblies (102B and 114B) are shown to be adjusted to a different position relative to their associated inner assemblies (102A and 114A) in FIGS. 4A and 4B as to that shown in FIG. 1.

The platform 130 may include a structure or body portion 150 having a generally flat surface for supporting a user of the ladder 100. In the presently considered embodiment, the body portion 150 is pivotally coupled with the rails 104 of the inner assembly 102A. For example, pins 152 may be coupled between the body portion 150 of the platform 130 and brackets 154 that are associated with each rail 104 of the inner assembly 102A. The pins 152 enable the body portion 150 of the platform 130 to pivot or rotate relative to inner assembly 102A from a first, usable position, as shown in FIG. 4A, to a second, stored position, as shown in FIG. 4B.

To support the body portion 150 of the platform when in the usable position (such as shown in FIG. 4A), a pair of braces 156 may be coupled between the rails 104 of the inner assembly 102A and the body portion 150 of the platform 130. For example, each brace 156 may include a slot 158 which slidably receives a pin 160 coupled to the body portion 140. The pin 160 abuts a bottom surface of the slot such that weight applied to the body portion is transferred through the pins 160, through the braces 156, and to the rails 104 of the inner assembly 102A by way of another pin 162 that is coupled with the rails 104 of the inner assembly 102A. When the body portion 150 is pivoted from the useable position to the stored or stowed position, the braces 156 rotate about the pins 162 that are coupled with the rails 104 of the inner assembly 102A while the pins 160 coupled to the body portion 150 slide within the slot 158 of the braces 156.

Figure 5A:
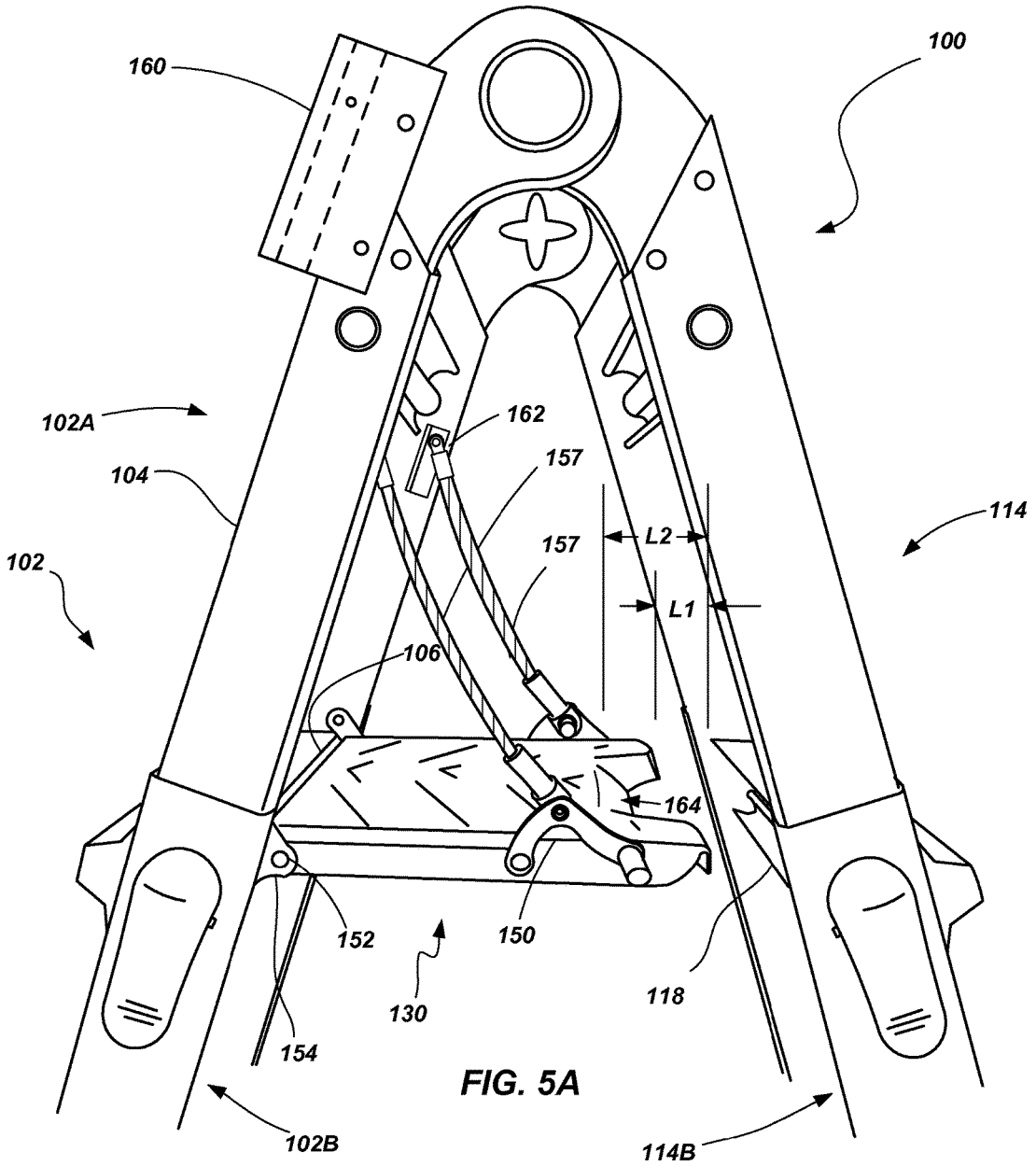
FIGS. 5A and 5B are enlarged perspective views of a ladder showing certain details in accordance with another embodiment.
Figure 5B:
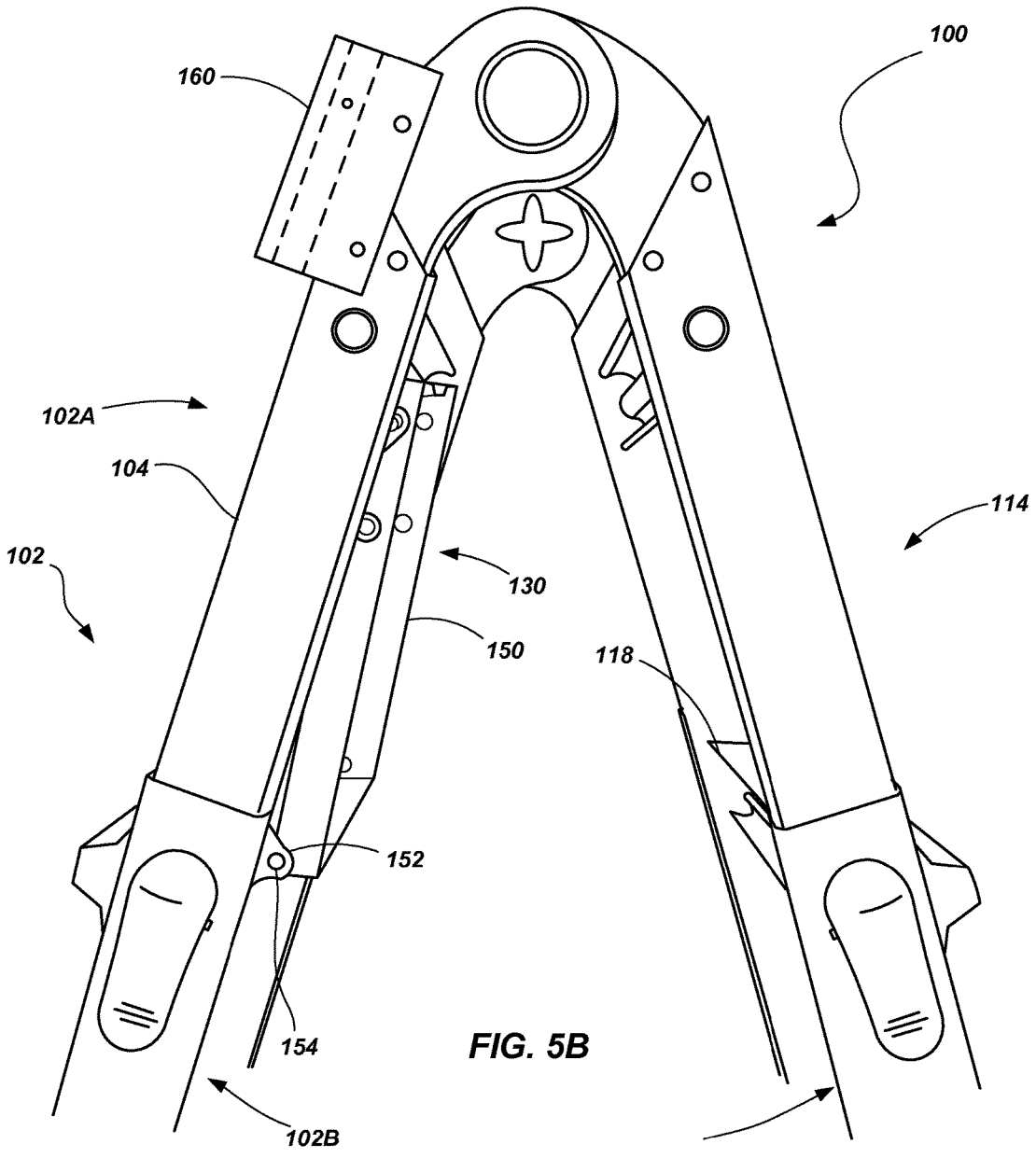

Referring briefly to FIGS. 5A and 5B, another embodiment of the platform 130 is shown. The platform 130 again includes a body portion 150 pivotally coupled with the rails 104 of the inner assembly 102A such as by pins 152 and brackets 154 or other appropriate structures or mechanisms. As described above, the pins 152 enable the body portion 150 of the platform 130 to pivot or rotate relative to inner assembly 102A from a first, usable position, as shown in FIG. 5A, to a second, stored position, as shown in FIG. 5B. When the body portion 150 is placed in a usable position (as shown in FIG. 5A), the body portion 150 may be supported by a cable 157 or other tether member coupled between the body portion 150 and the rails 104 of the inner assembly 102A. The cables 157 or tethers may be configured to resist a load in tension (i.e., when a user stands on the body portion 140) while providing little or no such resistance in compression so that they may bend or collapse when the body portion 150 is pivoted to a stored state (FIG. 5B). Such a configuration may provide additional advantages of reducing potential pinch points during the displacement of the body portion 150 relative to the rail assembly. Such a configuration may also provide certain manufacturing or usability advantages in comparison with the use of braces.

As shown in FIGS. 4A and 5A, the body portion 150 of the platform 130 is positioned adjacent, and at the same elevation, as a rung 106 of the inner assembly 102A of the first rail assembly 102. As previously noted, in one embodiment, the body portion 150 may be positioned adjacent, and at the same elevation as, the rung 106 that is second from the top when the ladder is in a step ladder configuration. Thus, when a user is standing at this elevation, they may place substantially the entirety of their feet on the combined surface of the body portion 150 and the adjacent rung 106. Having a greater surface area to stand on provides the user with increased stability and reduces the fatigue and discomfort that might otherwise be experienced by the user when standing for extended periods of time.

It is noted that the body portion 150, when in the usable position, extends adjacent a rung 118 of the inner assembly 114A of the second rail assembly 114. In one embodiment, the body portion is sized so that a relatively small gap exists between the end of the body portion 140 and the rung 118 associated with the second rail assembly 114B. For example, in one embodiment a gap exhibiting a distance L1 of approximately 1.75 inches may exist between the closest surfaces of the body portion 140 and the rung 118 of the second rail assembly 114, while a gap exhibiting a distance L2 of approximately 3 inches exists between the rung 118 and the indented portion 164 that serves as a handle. These gaps provide a desired clearance between the platform 130 and the second rail assembly for deployment from a stored and useable state while also still enabling a user to utilize the platform 130 while standing on the rungs (118 and 122) of the second rail assembly 114. In essence, a user will bridge the gap between the rung 118 and the body portion 140 of the platform 130 with their foot while standing on the second rail assembly. It is noted that the gap may be smaller or larger than the examples just described. For example, a gap of between approximately 1/16 of an inch and approximately 3 inches between the closest portions of the body portion 140 and the rung 118 are contemplated as being utilized. A platform, such as described with respect to FIGS. 3A and 3B may be configured to support, for example, a weight of approximately 300 pounds or more.

One advantage of placing the platform at the location shown and described with respect to FIGS. 1, 3A and 3B, is that it encourages users to only climb as high as is recommended by the manufacturer. It is noted that the American National Standards Institute (ANSI) recommends that the user shall not step or stand on the top step of a combination ladder when it is used as a self-supporting ladder. Thus, placing the platform 130 at the second highest rung will encourage the user to only climb as high as the platform 130. However, it is noted that the platform 130 could be placed at other locations so that it is associated with other rungs. Furthermore, more than one platform may be employed with the ladder 100 if desired.

While the platform 130 may be coupled with the rail assembly (102 or 114) differently than described herein, one advantage of coupling the platform 130 with the inner assembly (102A or 114A) is that it will remain at the same distance from the top of the ladder 100 when it is used as a step ladder regardless of any height adjustments that may be made. In other words, if placed adjacent the second highest rung (104 or 118), it will remain adjacent the second highest rung regardless of the adjustment of the inner and outer rail assemblies 102A and 102B relative to one another.

It is noted that the platform 130, as described above, is fixed to the ladder 100 as a permanent component and it is not removable from the ladder without substantial disassembly, or possibly even destruction of, some of the ladder components. In other words, the ladder 100 is manufactured with the platform 130 being an integral component of thereof. Additionally, as described above, while the platform 130 may appear somewhat like a spreader mechanism on a conventional step ladder, the platform 130 is only fixed to one of the rail assemblies (e.g., 102), not both. Stated another way, the platform is independent of one or the rail assemblies (e.g., 114).

While shown as being coupled or fixed with the first rail assembly 102 (and, more particularly, the inner assembly 102A of the first rail assembly 102), the platform 130 may be coupled or fixed with the second assembly 114 instead. It is also noted that, while shown and described as maintaining a gap between the body portion and an adjacent rung of the opposing rail assembly, in other embodiments the body portion 140 may be configured to engage or rest on a top surface of the adjacent rung. However, in such an embodiment, while the platform 130 may be in contact with portions of both the first rail assembly 102 and the second rail assembly 114 when in the useable position, it only remains fixed to one of the two rail assemblies (e.g., as is evident from viewing the stowed or stored position shown in FIG. 3B which would remain substantially unchanged).

Figure 6:
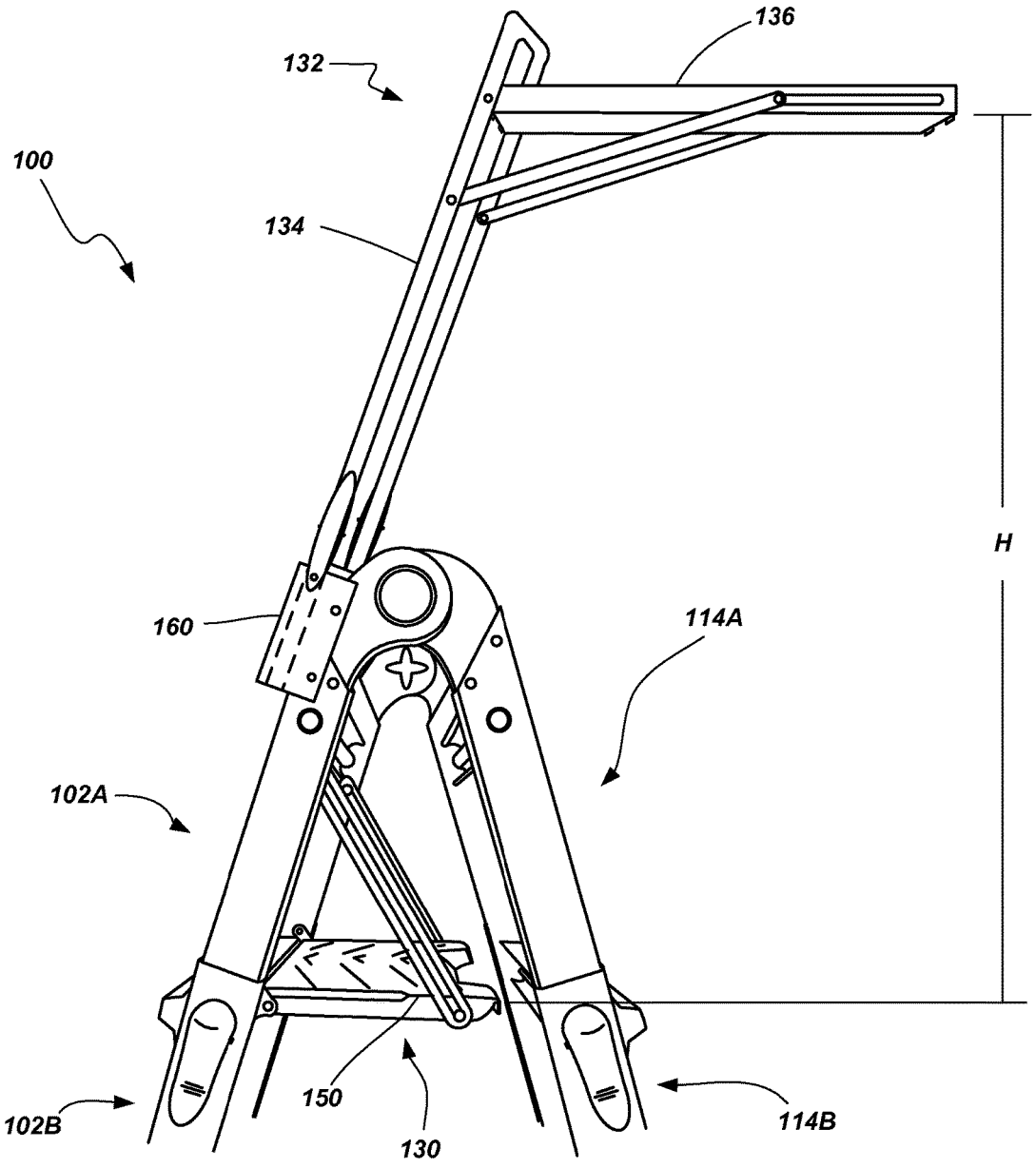
FIG. 6 is an enlarged perspective view of the ladder shown in FIG. 1 showing additional details.

Referring now to FIG. 6, brackets 160 may be coupled to the first rail assembly 102 (and/or the associated hinge component) to facilitate installation of the above-described component 132. (It is noted that the brackets are also shown in FIGS. 1, 4A, 4B, 5A and 5B). Locking mechanisms located near the lower end of the component 132 may be associated with the handrail 134 to engage the brackets 160 and maintain the component 132 in a desired position. With the component 132 installed and the tray 136 extending substantially horizontally as shown, the tray 136 is placed in a working position that is at a desired height above the platform 130. Additionally, because both the component 132 and the platform 130 are coupled to the inner assembly 102A of the first rail assembly 102, the tray 136 and the body portion 140 of the platform maintain the same distance "H" between one another regardless of any height adjustments to the ladder 100 when it is in a self-supporting or step ladder configuration.

Figure 7:
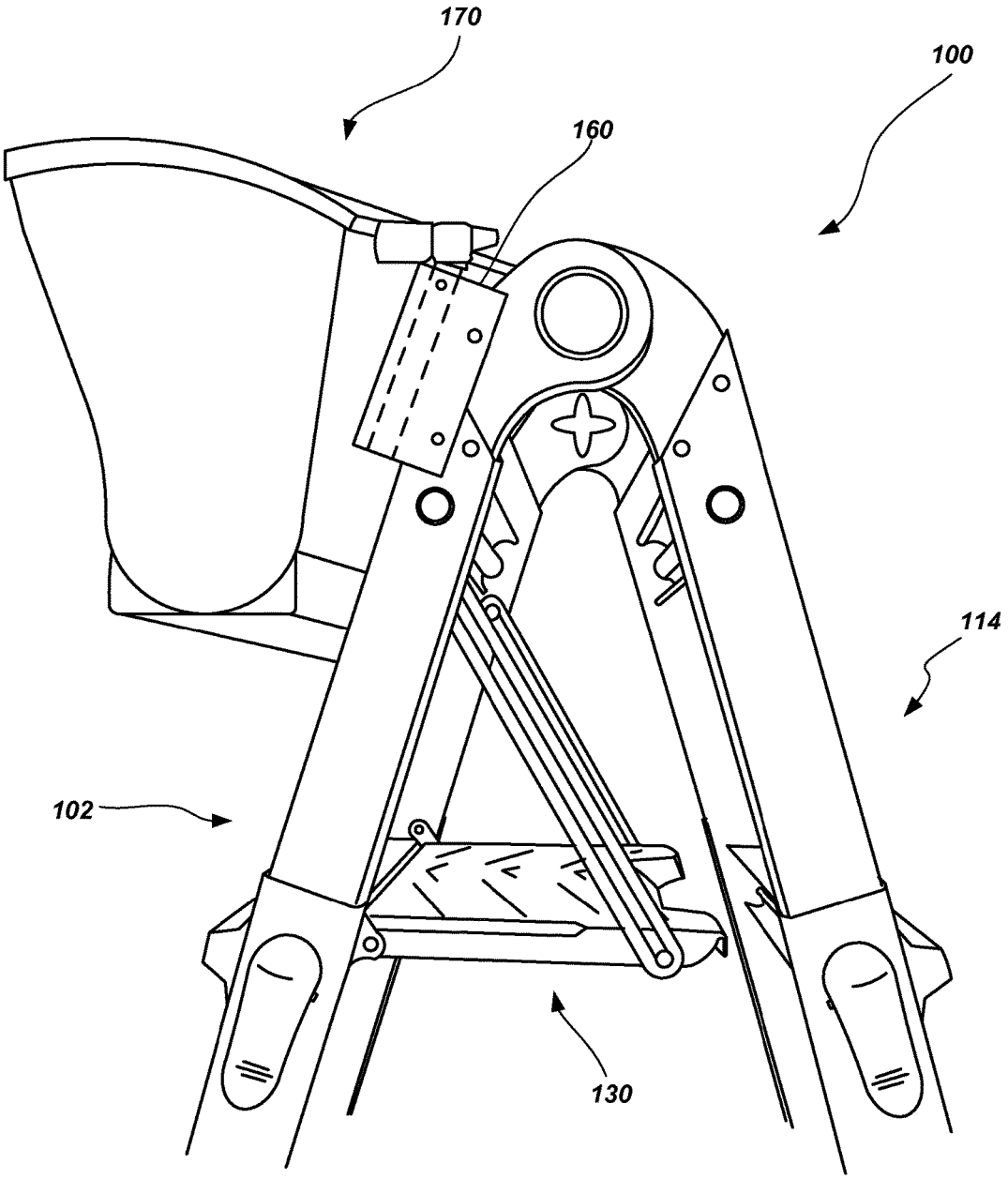
FIG. 7 is an enlarged perspective view of the ladder shown in FIG. 1 showing further details in association with another embodiment.

Referring briefly to FIG. 7, the ladder 100 is shown with another accessory coupled with the same brackets 160 that are used for installation of the rail and tray component 132. The accessory includes a paint tray 170 or a bucket that is sized and configured to hold a desired amount of paint. The paint tray 170 is also configured to receive a paint roller, enabling a paint roller to be dipped or immersed in the paint, so that a painter may have easy access to paint for their roller (and/or brush) while standing on the ladder 100. Such a paint tray 170 may include, for example, that which is described in U.S. Patent Application Publication No. 2010/0282540, filed May 5, 2010, the disclosure of which is incorporated by reference herein in its entirety. Of course other accessories may also be coupled with the brackets 160 as may be desired. When both the brackets 160 and the platform are coupled with the same assembly (e.g., with the inner assembly 102A), the brackets 160 and the platform 130 maintain a set distance between them so as to provide an efficient working environment for a user of the ladder 100.

Figure 8:
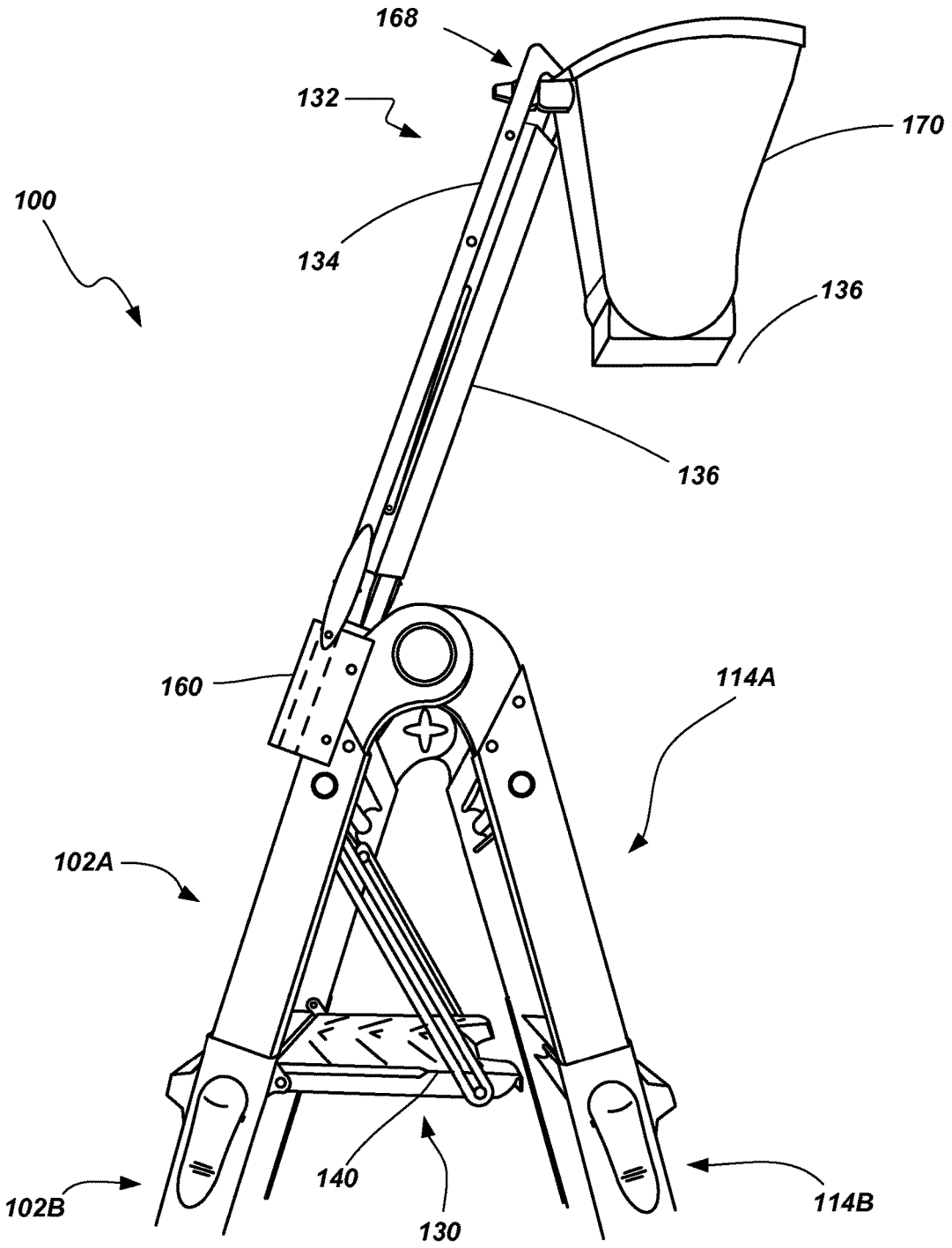
FIG. 8 is an enlarged perspective view of the ladder shown in FIG. 1 showing details in association with another embodiment.
Figure 9:
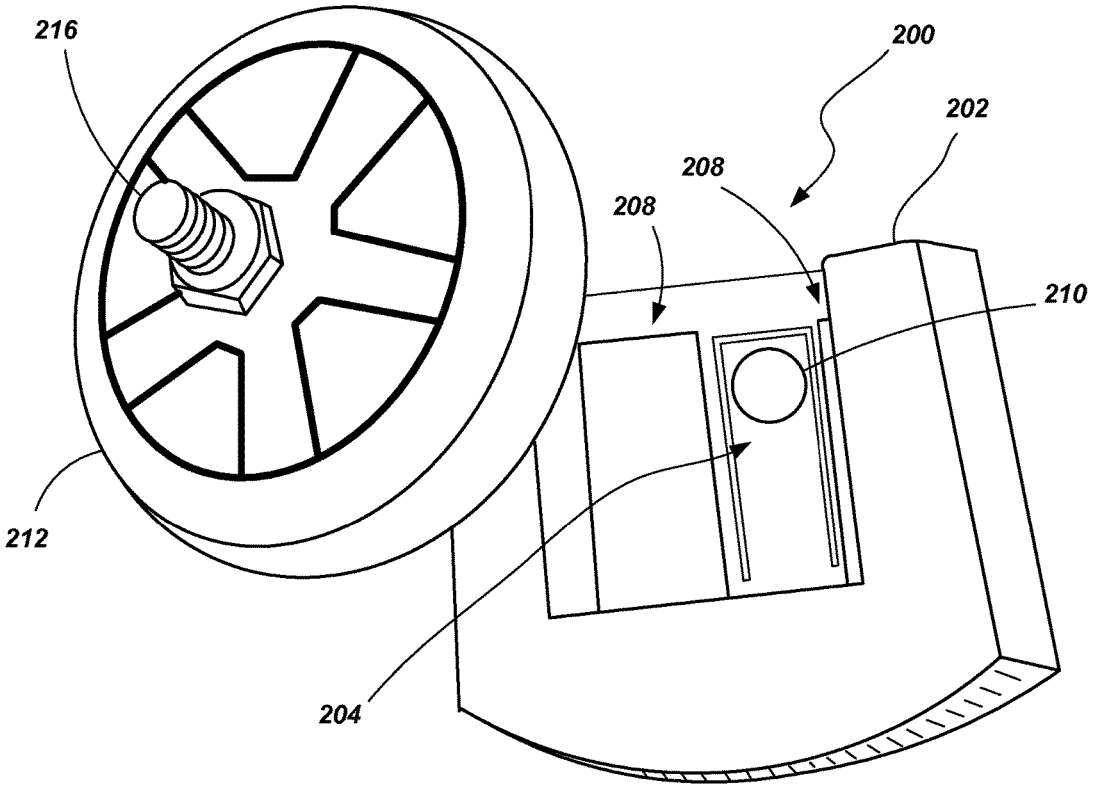
FIGS. 9-12 show various views of a ladder component in accordance with another embodiment of the present invention.

Referring to FIG. 8 in conjunction with FIG. 2, in another embodiment, the rail and tray component 132 may include brackets 168 for coupling with other accessories such as the paint tray 170. In one particular embodiment, as shown in FIG. 2, the brackets 168 may be coupled to the rail portion 134. However, in other embodiments, the brackets 168 may located and configured differently. As seen in FIG. 8, the paint tray 170 (or other accessory) may be coupled with the component 132 at a height that provides ready access while a user is standing on the platform 130. Again, when the component 132 and the platform 130 are both coupled to the same rail assembly (e.g., the inner rail assembly 102A of the first rail assembly 102), the paint tray 170 or other accessory maintains a fixed elevation distance relative to the platform. It is noted that that the tray 136 is positioned in what has been referred to above as a "stowed state" with the tray 136 being within a common plane (or at least parallel to) the handrail 134. This enables the paint tray 170 or other accessory to be coupled with the handrail 134 without interference with the tray 136.

Referring now to FIGS. 9-12, with additional reference to FIG. 1, a foot 200 for a ladder is shown in accordance with another embodiment of the present invention. The foot 200 may be configured for easy assembly with an associated ladder rail (e.g., outer rail 108—FIG. 1) to provide more efficient manufacture and assembly of the ladder.

Figure 10:
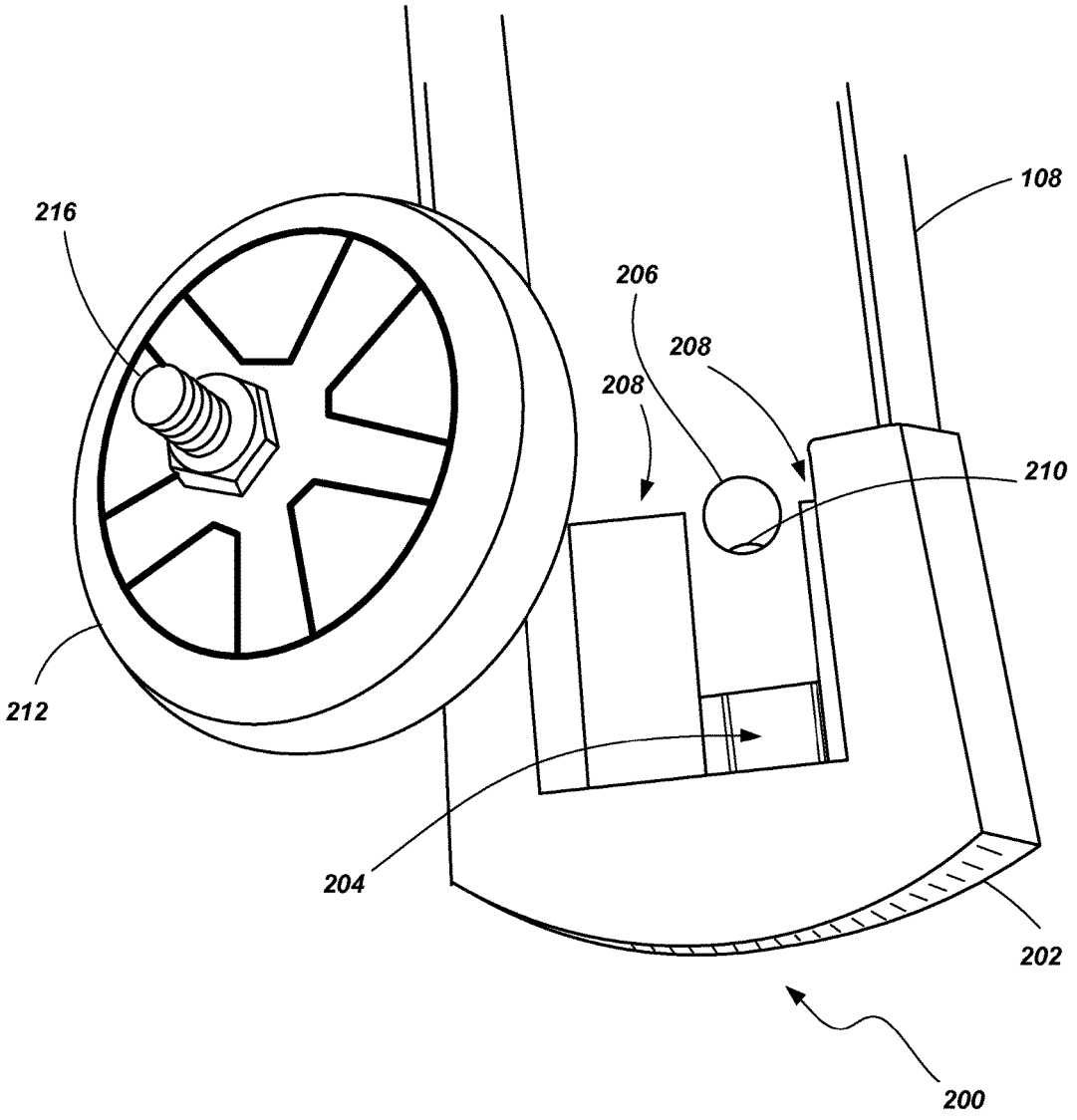
Figure 11:
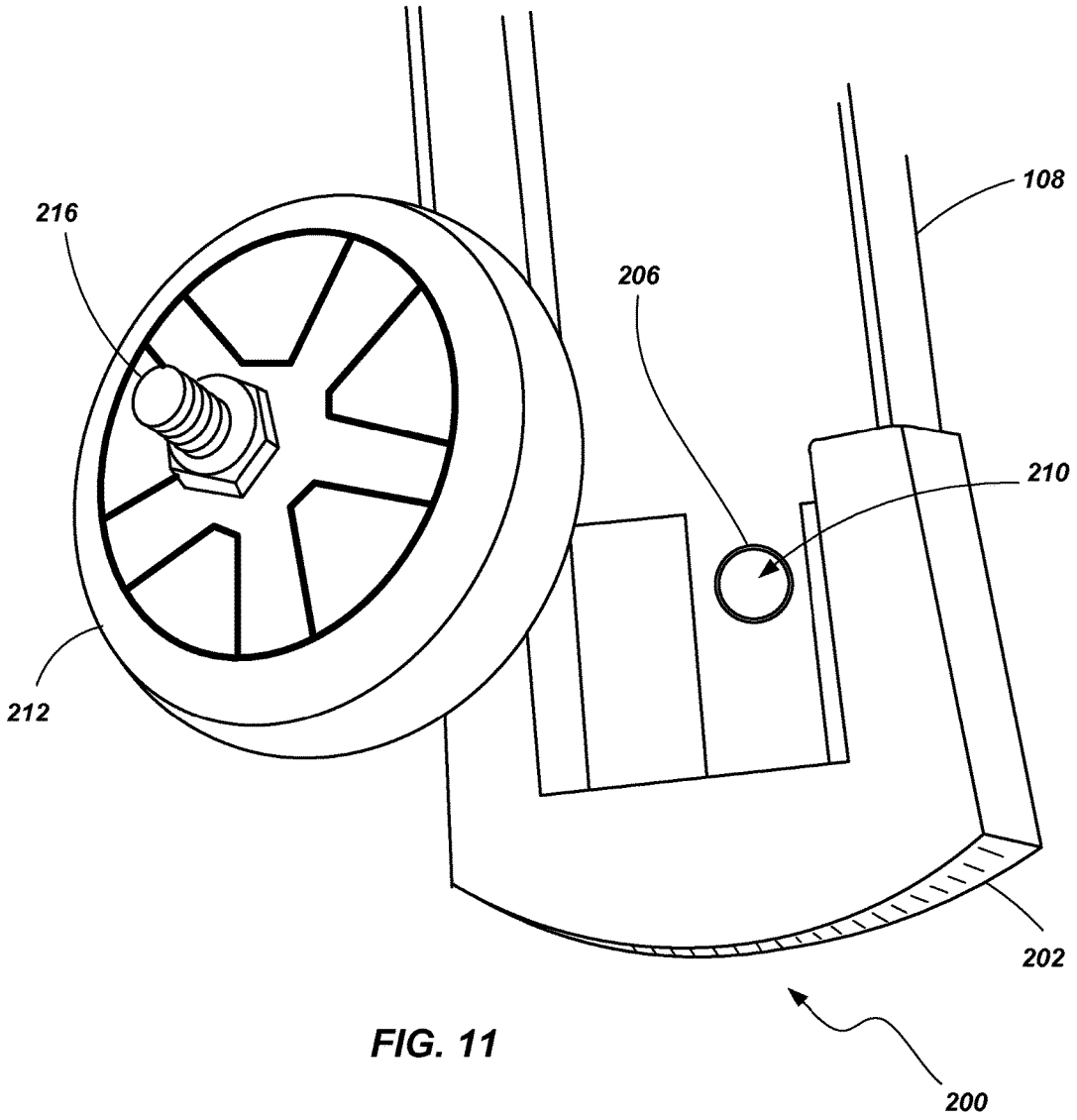
Figure 12:
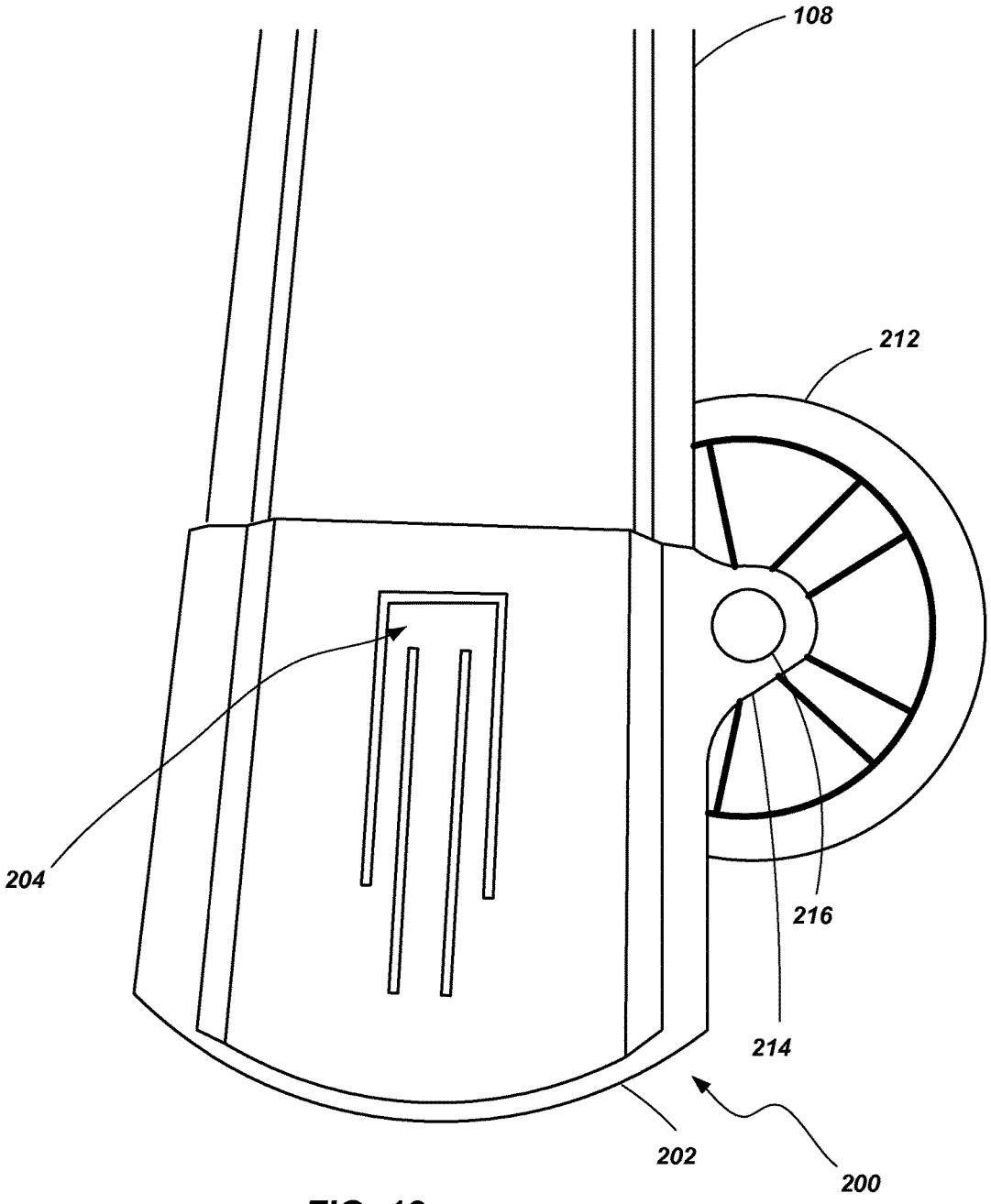

In one embodiment, the foot 200 includes a body portion 202 that slides over a corresponding end of an associated rail. A flexible lock tab 204 may be associated with the body portion 202 and configured to engage with the complementary opening or keyway 206 (see FIGS. 10 and 11) and an associated rail (e.g., rail 108 in FIG. 1). Thus, for example, as shown in FIG. 10, with a foot 200 being installed on the end of an associated rail, the rail may engage channels 208 defined by body portion 202 until a button or protrusion 210 associated with the lock tab 204 engages the opening or keyway 206 of the rail as shown in FIG. 11. Removal of the foot 200 would be accomplished by pressing the button or protrusion 210 to disengage it from the opening or keyway 206. With the protrusion 210 being disengaged from the keyway 206, the foot could then be slid off of the rail. The foot 200 may be formed of a variety of materials using a variety of manufacturing techniques. In one particular embodiment the foot 200 and can be made of a plastic material and may be formed as a molded component.

The body portion 202 of the foot 200 may be formed such that a wheel 212 may be integrally coupled therewith. For example, as shown best in FIG. 12, the body portion 202 may include a protrusion 214 or other feature having an opening through which a wheel axle 216 may pass. The wheel axle 216, along with appropriate fasteners or other structures, may couple the wheel 212 to the body portion 202 such that the wheel 212 rotates relative to the body portion 202 about an axis defined by the wheel shaft 216. When such an embodiment is employed in a ladder, the wheel 212 may be positioned relative to the body portion 202 of the foot 200 so that it is not in contact with the ground (or underlying support surface) when the ladder is in an intended configuration and orientation for use (e.g., such as shown in FIG. 1). However, the wheel 212 is also positioned so that when the ladder is collapsed into a stored state (i.e., with the first and second assemblies 102 and 114 being rotated in position immediately next to each other), the ladder may be tipped and drug such that it rolls on the wheels 212.

Of course, it is noted that the foot 200 does not need to be coupled to a wheel or otherwise include any features for coupling to a wheel. Rather, each foot shown in FIG. 1 (i.e., four feet associated with the inner rail assemblies 102A and 114A and four feet associated with the outer rail assemblies 102B and 114B) may be configured to include the locking and assembly features described above, regardless of whether or not they are coupled to a wheel. The use of such a foot enables the easy assembly and disassembly of the foot from the rail in case, for example, a foot needs to be replaced due to wear or if a different style of foot is desired (e.g., a spiked foot, a gimbaled foot, or a foot that has a different coefficient of friction for engagement of a supporting surface).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A ladder comprising:

at least one rail assembly including a pair of rails and at least one rung coupled between the pair of rails;

a first foot removably coupled with an end of an associated rail of the pair of rails, the foot including a body portion configured to cover an end of the associated rail, the body portion including a first wall having a flexible locking tab formed therein and extending in the same plane as the first wall, the locking tab having a feature formed at a free end of the locking tab including a protrusion that extends into a through hole formed in the associated rail, wherein a surface of the flexible locking tab is exposed to a user on a first side of the associated rail and wherein the protrusion extends through the through hole and is exposed on second side of the associated rail.

2. The ladder of claim 1, wherein the feature formed in the free end of the locking tab is selectively displaceable from the through hole, and wherein the body portion of the foot further defines at least one channel to receive a portion of the associated rail, the body being configured to slide along a length of the associated rail when the feature formed in the free end of the lacking tab is disengaged from the through hole.

3. The ladder of claim 1, further comprising a wheel rotatably coupled with body portion of the first foot.

4. The ladder of claim 3, wherein, when the ladder is placed on a supporting surface in an intended operating orientation, the wheel does not contact the supporting surface.

5. The ladder of claim 1, further comprising a second foot coupled with an end of the other rail of the pair of rails, the second foot including a body portion configured to cover an end of the other ladder rail, the body portion including a first wall having a flexible locking tab formed therein and extending in the same plane as the first wall, and a feature formed at a free end of the locking tab extending into a through hole formed in the other rail.

6. The ladder of claim 1, wherein the protrusion is formed adjacent the free end of the locking tab.

7. The ladder of claim 1, wherein the foot comprises plastic.

8. The ladder of claim 1, wherein the body, including the first wall and its locking tab, is a molded structure.

* * * * *